US009382715B2

(12) United States Patent
Cottier

(10) Patent No.: US 9,382,715 B2
(45) Date of Patent: Jul. 5, 2016

(54) BUILDING ARRAY

(71) Applicant: James Hardie Technology Limited, Dublin (IE)

(72) Inventor: John Cottier, Rosehill (AU)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 14/349,567

(22) PCT Filed: Oct. 1, 2012

(86) PCT No.: PCT/EP2012/004114

§ 371 (c)(1),
(2) Date: Apr. 3, 2014

(87) PCT Pub. No.: WO2013/050130

PCT Pub. Date: Apr. 11, 2013

(65) Prior Publication Data

US 2014/0260043 A1 Sep. 18, 2014

(30) Foreign Application Priority Data

Oct. 3, 2011 (GB) ..... 1116977.8

(51) Int. Cl.
*E04F 13/08* (2006.01)
*E04F 13/16* (2006.01)
(Continued)

(52) U.S. Cl.
CPC ..... *E04F 13/0801* (2013.01); *E04F 13/0826* (2013.01); *E04F 13/16* (2013.01);
(Continued)

(58) Field of Classification Search
CPC ..... E04F 13/0801; E04F 13/0826; E04F 15/02044; E04F 15/02177; E04F 19/02; E04F 13/16; E04F 15/102
USPC ..... 52/460, 461, 464, 65, 466, 468, 489.1, 52/582.1, 582.2, 586.1, 778, 779
See application file for complete search history.

(56) References Cited

U.S. PATENT DOCUMENTS 3,005,293 A 10/1961 Hunter
3,530,633 A * 9/1970 Scott ..... E04B 1/6145 52/235

(Continued)

FOREIGN PATENT DOCUMENTS

DE 20 2007 009851 U1 9/2007
EP 0 470 814 A1 2/1992
WO WO 2013/050130 A1 4/2013

OTHER PUBLICATIONS

International Search Report and Written Opinion for corresponding PCT Application No. PCT/EP2012/004114, filed Oct. 1, 2012, dated Feb. 1, 2013, 14 pages.

*Primary Examiner* — Brian Glessner
*Assistant Examiner* — Adam Barlow
(74) *Attorney, Agent, or Firm* — Knobbe, Martens, Olson & Bear, LLP

(57) ABSTRACT

A building array (800, 900, 902) comprising at least one building element (100, 200) having a first face (102, 202), a second face (104, 204) and a peripheral edge member (108, 208), the first face and second face being spaced apart to define an intermediate portion (106, 108), the peripheral edge member extending around the intermediate portion whereby at least a portion of the peripheral edge member comprises an edge profile (112, 212); and at least one boundary element (300, 400, 500, 600) comprising a planar base member (304, 404, 504, 604) removably attachable to a structural support element (802), at least one flange (306, 406, 506, 606) extending substantially orthogonally from the planar base member and an edge restraining formation (310, 410, 510, 610) extending laterally from the flange remote from the planar base member. The edge restraining formation is configured for releasably engaging with the edge profile of the building element. The at least one building element and the at least one boundary element are arrangeable together in series on a structural support element to form the building array.

30 Claims, 7 Drawing Sheets

(51) Int. Cl.
*E04F 15/02* (2006.01)
*E04F 15/10* (2006.01)
*E04F 19/02* (2006.01)

(52) U.S. Cl.
CPC ..... *E04F15/02044* (2013.01); *E04F 15/02177* (2013.01); *E04F 15/102* (2013.01); *E04F 19/02* (2013.01); *E04F 2015/02055* (2013.01); *E04F 2015/02094* (2013.01)

(56) References Cited

U.S. PATENT DOCUMENTS 4,128,983 A * 12/1978 Matsubara ..... E04B 1/615 52/238.1
4,370,841 A * 2/1983 Hayashi ..... E04B 1/6154 52/464
4,603,528 A * 8/1986 Sigerist ..... E04F 13/0803 52/464
6,374,552 B1 * 4/2002 Price ..... E04B 1/34342 52/169.12
6,470,641 B1 * 10/2002 Faure ..... E04B 5/12 52/391
7,805,902 B2 * 10/2010 Martel ..... E04F 15/02 411/461
8,006,458 B1 * 8/2011 Olofsson ..... E04F 15/02 52/489.1
8,011,153 B2 * 9/2011 Orchard ..... E04F 15/02 24/295
8,919,068 B2 * 12/2014 Wright ..... E04F 15/02183 52/302.1
8,979,052 B2 * 3/2015 Uota ..... E04F 13/0846 248/226.11
2009/0229212 A1 9/2009 Sorini
2015/0040508 A1 * 2/2015 Zhang ..... E04F 15/02038 52/582.1

* cited by examiner

BUILDING ARRAY

FIELD OF THE INVENTION

The present invention relates to a building array comprising a building element and a boundary element which are suitable for use as decking, flooring or cladding materials, in particular the building array is suitable for use as a non-combustible exterior decking, interior flooring or an interior and exterior cladding array.

The invention has been developed primarily for use as a non-combustible decking array for exterior use in a residential dwelling or as an exterior and/or interior cladding system in a residential dwelling or commercial building. The use of the present invention will be described hereinafter with reference to the aforementioned applications. It is to be understood that reference to the use of the present invention in relation to a non-combustible decking array or as an exterior or interior cladding system should not be seen as limiting. It is also to be understood that the terms decking array, exterior cladding system and interior cladding system are used interchangeably throughout the specification to describe the present invention.

BACKGROUND OF THE INVENTION

Any discussion of the prior art throughout the specification should not be considered as an admission that such prior art is widely known or forms part of the common general knowledge in the field.

Aesthetically pleasing exterior decking partially or completely surrounding at least one level of a residential dwelling construction is known. Decking is traditionally made of wood for its ease of use and installation. In recent years, decking has also been made from wood-plastic composites (WPCs) which mimic the appearance and feel of timber. Neither timber nor WPC decking is fire resistant. Consequently the hazard of using such material to build decking particularly in fire prone areas is prohibitive. Separately, construction of decking, could also be prohibited by local or national building codes or regulations.

Attempts have been made in the past to modify the physical properties of timber to improve its fire resistant properties. Such attempts include, for example, impregnation of timber materials with fire retardant chemicals. The cost of treated timber is higher than that of untreated timber, which in turn impacts the end-user. There are also environmental concerns when using treated timbers due to the increased possibility of environmental pollution should the chemicals be released from the timber.

Furthermore the original method of fastening building materials, such as decking or cladding, to underlying support structures has been nailing through the face of the building material and into the underlying support structure. Face nailing is quick and requires a minimal initial skill level but subsequently requires a higher skill trades person to disguise or obscure fixing points to enable an acceptable finish level to be created in the completed construction.

Different cladding applications require different nail installation techniques, either ending in nail heads sitting just above the cladding surface, flush with the cladding surface, or punched below the cladding surface. When installing over large cladding expanses, nailing to a consistent nail head position is difficult. In addition, nailing or screw fastening onsite is not desirable when the cladding material is prefinished with a decorative surface coating. Precoating fasteners to colour match provides some level of disguise but the actual fastener heads are still visible, detracting from the aesthetics of a completed wall section installation.

OBJECT OF THE INVENTION

It is an object of the present invention to overcome or ameliorate at least one of the disadvantages of the prior art, or to provide a useful alternative.

It is therefore an object of the present invention to provide an aesthetically pleasing building array suitable for use as a non-combustible decking array for exterior use in a residential dwelling or as an exterior and/or interior cladding system in a residential dwelling It is acknowledged that the term 'comprise' may, under varying jurisdictions be provided with either an exclusive or inclusive meaning. For the purpose of this specification, the term comprise shall have an inclusive meaning that it should be taken to mean an inclusion of not only the listed components it directly references, but also other non-specified components. Accordingly, the term 'comprise' is to be attributed with as broad an interpretation as possible within any given jurisdiction and this rationale should also be used when the terms 'comprised' and/or 'comprising' are used.

Further aspects of the present invention will become apparent from the ensuing description which is given by way of example only.

SUMMARY OF THE INVENTION

According to the invention, there is provided a building array comprising, at least one building element comprising a first face, a second face and a peripheral edge member, the first face and second face being spaced apart to define an intermediate portion, the peripheral edge member extending around the intermediate portion whereby at least a portion of the peripheral edge member comprises an edge profile; and at least one boundary element comprising a planar base member removably attachable to a structural support element, at least one flange extending substantially orthogonally from the planar base member and an edge restraining formation extending laterally from the flange remote from the planar base member wherein the edge restraining formation is configured for releasably engaging with the edge profile of the building element, whereby, the at least one building element and the at least one boundary element are arrangeable together in series on a structural support element to form the building array.

The advantage of the building array of the present invention is that it provides an aesthetically acceptable level of surface finish in a completed construction that is also quick and simple to install. Conveniently the building elements of the invention can be formed from any material suitable for use in an exterior or interior building application, as required. Such materials may include timber, engineered cement composites including fibre cement, engineered wood composites, polymers, polymer composites and the like. When a non-combustible building array is required by an end user it is preferable for the building elements to be formed for a suitable non-combustible material such as fibre cement.

In one embodiment of the invention each of the first and second face, the intermediate portion and the peripheral edge member are integrally formed together as a single unit.

In a further embodiment of the invention the thickness of the intermediate portion is variable and is selected by the manufacturer. In the preferred embodiments of the invention the thickness of the building elements are tailored to provide consumers with a choice of predetermined thickness options for a given product or product range. In one embodiment of the invention the intermediate portion of the building element is at least approximately 12 mm thick. The advantage of this particular thickness is that the building element is able to sustain significant wind loading when placed in a building array which is in the form of an exterior cladding system.

In a further embodiment of the invention, the integrally formed peripheral edge member comprises two pairs of spaced apart opposing side edges. In a preferred embodiment of the invention each pair of spaced apart opposing side edges is positioned in a contiguous orthogonal arrangement relative to the other pair of spaced apart opposing side edges such that each side edge in a pair is in abutment with both side edges in the other pair, the side edges thereby extending around each side of a substantially rectangular building element enclosing the intermediate portion. It is to be understood that the substantially rectangular building element of the invention can be of any shape or size as determined by the person skilled in the art. It is preferable when the building element is being used as part of a building array in the form of a decking system that the substantially rectangular building element is in the form of an elongate substantially rectangular building element.

In a further embodiment of the invention the edge profile can be formed on one or more of the side edges of the building element.

In a further embodiment the edge profile is in the form of a recess or channel or groove.

In a further embodiment of the invention, the edge profile divides the peripheral edge member or side edges of the building element into a first portion and a second portion, the first portion corresponding to the section of the building element including and adjacent to the first face and the second portion of the building element including and adjacent to the second face. The relative position of the edge profile is selected to provide alternate aesthetic effects within the building array or completed construction. It is preferable to ensure that a sufficient thickness of material is retained within the first and second portions such that the first portion has sufficient depth to assist in prevention of damage to the building element during handling and installation.

In one embodiment of the invention, the edge profile has a predominantly central position on the peripheral edge member or side edge.

In a further embodiment of the invention, the building array comprises a building element in which the second portion of the peripheral edge member or side edge is of a different size to that of the first portion of the peripheral edge member or side edge. In one embodiment of the invention the distance between opposing points on the peripheral edge member of the first portion is greater than the distance between opposing points of the peripheral edge member of the second portion such that the second portion is shortened relative to first portion of the peripheral edge member or side edge.

In a further embodiment of the invention the first face is defined as the visual face or surface of the building element. In one embodiment of the invention the first face is adapted to receive a range of surface treatments such as a decorative paint finish, tiles, and the like. In another embodiment of the invention the second face is adapted to receive a range of surface treatments. In one embodiment of the invention, the surface treatments are mechanically or chemically fixed to the second face to modify the aesthetic or physical properties of the building array. An example of a surface treatment includes adhesion of a thermal insulation material to the second face.

In a further embodiment of the invention both the first and second faces are adapted to receive one or more of a range of surface treatments, examples of which are outlined above.

In one embodiment of the invention the boundary element comprises a boundary edging element suitable for use as the first edge or terminating edge of a building array. The boundary edging element of the invention comprises a planar base member, at least one flange extending substantially orthogonally from the planar base member and an edge restraining formation extending laterally from the flange remote from the planar base member, whereby the base member, flange and edge restraining formation are arranged to form a substantially 'C'-shaped channel.

In a further embodiment of the invention the flange of the boundary edging element extends substantially orthogonally from a central or median position on the planar base member such that the planar base member extends outwards in opposing directions on either side of the flange. It is to be understood that the portions of the planar base member extending on either side of the flange do not need to be equidistant.

In a further embodiment of the invention, the boundary edging element of the invention is adapted to receive the first face of the building element thereby providing a capping member that encloses at least a portion of the peripheral edge member of the building element.

In a further embodiment of the invention the boundary element comprises a boundary joining element, comprising at least two spaced apart flanges extending substantially orthogonally from the planar base member, whereby the two spaced apart flanges and base member are configured to form at least one substantially "U" shaped channel. In this embodiment of the invention, each flange terminates in a leg or edge restraining formation extending substantially parallel to the planar base member.

In a further embodiment of the invention the boundary joining element comprises a planar base member which is configured together with flanges to provide three conjoined channels wherein the central channel is a substantially "U"-shaped channel, the base member and flanges of the boundary joining element forming the base member and side members of the central channel and the channels on either side of the central channel are substantially shaped channels facing in opposing directions, the flanges, base member and edge restraining formation forming the base members and respective side members of the channels positioned on either side of the central channel.

In a further embodiment of the invention, the boundary joining element is sized and shaped to facilitate a junction between two panels of unequal thickness or alternatively a junction between a building element of the invention and an alternate building material or structure.

In a further embodiment of the invention the base members of the boundary elements further comprise at least one fixing location indicators. One or more fixing location indicators being selected from the group comprising an aperture, recesses such as indentations or surface markings engraved into the surface or applied to the surface.

In one embodiment of the invention the fixing indicators are positioned on the base member such that a building element will cover the fixing location indicators when positioned within a building array.

The advantage of the fixing indicators is that they show a user the preferred point at which the boundary elements should be fixed to a structural support member. Ideally, the boundary elements are secured to a structural support element, by means of mechanical fixing means such as nails, screws, staples and/or scrails.

The boundary elements engage with the building elements such that boundary elements attach the building elements to a structural support member without the need for face fixing of the building elements. Significantly, the boundary elements when secured to a structural support member prevent substantial lateral or orthogonal movement of the building element relative to the structural support member. The advantage of this is that the building elements have freedom to cycle through thermal expansion and contraction effects due to environmental conditions without stress being placed at specific sites of a building element where mechanical fixing means would normally be positioned.

In a further embodiment of the invention, the building array further comprises a cover element comprising a top member including a first cover element face and a second cover element face and a pair of legs, each leg extending substantially orthogonally from the second cover element face. The cover element is used to conceal at least a portion of boundary joining element.

In a further embodiment of the invention each leg further comprises a restraining formation shaped to form a frictional fit of the cover element into the "U" shaped channel of the boundary joining element.

In a further embodiment of the invention, the flanges of the boundary joining element are provided with a detent at an appropriate location to seat and hold the restraining formation of the cover element such that the restraining formation can only be released from the detent by application of an external force. Advantageously, the restraining formation and detent are of complimentary shape to enable the detent to position and hold the restraining formation.

In a further embodiment of the invention, the cover element comprises a protrusion extending from at least a portion of the first cover element face. The protrusion is provided to alter the direction of flow of water away from the visual face of the building elements when in a building array. By altering the direction of flow of water away from the building array, the opportunity for water to percolate between the cover element and the boundary element of the building array is minimised. Conveniently the protrusion can be of any suitable shape or form to achieve the desired effect. In one embodiment of the invention, the protrusion is in the form of an 'I' or an 'L' shaped protrusion. It is to be understood that these shapes should not be seen as limiting, any shape known to a person skilled in the art which will achieve the desired effect can also be used.

In a further embodiment of the invention, the first cover element face has an applied surface treatment. Ideally, the surface treatment is selected to suit the material from which cover element is made and is used to provide a low cost aesthetically pleasing finish on the first cover element face. For example, when the cover element is a metal cover element, surface treatments include abrading, machining, painting, etching, and/or anodising. Alternatively, in a further embodiment of the invention the surface treatment may consist of applying a polymer trim by chemically fixing the trim to the first cover element face. Usually, such a polymer trim would be chemically fixed by gluing.

In a further embodiment of the invention, the boundary elements and cover element are formed from any one of the materials selected from the group comprising metals, ceramics, polymers or polymer composites. In a further embodiment of the invention, the boundary elements, cover element and channels formed therein are preferably formed by techniques known to the person skilled in the art. For example, where the boundary elements or cover element are formed from a polymer or polymer composite material, the or each element may be formed by any suitable method known in the art, such as extrusion, pultrusion, injection moulding, compression moulding, vacuum forming and line bending. Alternatively, the boundary elements or cover element may be formed from a metal, by commonly known methods such as extrusion.

In a further embodiment of the invention the boundary elements or cover element may also be formed as discrete units or may be formed in predefined lengths, for example, in the form of elongate boundary or cover elements, depending on the forming method selected.

According to the invention, there is also provided a method of constructing a building array on a structural support element, the method comprising the steps of (a) installing a boundary element on at least a portion of the structural support element using at least one conventional fixing means, the elongate boundary element comprising a planar base member removably attachable to a structural support element, at least one flange extending substantially orthogonally from the planar base member and an edge restraining formation extending laterally from the flange remote from the planar base member;

(b) seating a first building element into the boundary element, the building element comprising a first face, a second face and a peripheral edge member, the first face and second face being spaced apart to define an intermediate portion, the peripheral edge member extending around the intermediate portion whereby at least a portion of the peripheral edge member comprises an edge profile configured for releasably engaging the edge restraining formation, the building element being seated such that the edge restraining formation of the boundary element engages with the edge profile of the building element;

(c) installing a further boundary element on a further portion of the structural support element using at least one conventional fixing means such that the edge restraining formation of the further boundary element engages with a further portion of the edge profile formation of the building element to secure the building element in position on the structural support element.

In a further embodiment of the invention the method further comprises the following steps after step (b) and before step (c);

(b1) installing a boundary element on a further portion of the structural support element using at least one conventional fixing means, the boundary element comprising at least two spaced apart flanges extending substantially orthogonally from the planar base member, whereby the two spaced apart flanges terminate in first and second edge restraining formations respectively, the two spaced apart flanges and base member are configured to form at least one substantially "U" shaped channel, such that the first edge restraining formation of the boundary element engages with an portion of the edge profile formation of the building element of step (b) to secure the building element of step (b) in position on the structural support element; and (b2) seating a further building element such that the second edge restraining formation of the boundary element engages with a portion of the edge profile formation of the further building element;

(b3) installing a further boundary element from step (b1) on a further portion of the structural support element using at least one conventional fixing means, such that the first edge restraining formation of the boundary element engages with an portion of the edge profile of the building element of step (b2) to secure the building element of step (b2) in position on the structural support element; and (b4) repeating the steps of (b2) and (b3) as required.

In a further embodiment of the invention, the method further comprises the step of;

(d) installing a cover element into the substantially "U" shaped channel of the boundary element of step (b1), the cover element comprising a top member including a first cover element face and a second cover element face and a pair of legs, each leg extending substantially orthogonally from the second cover element face.

When the building array of the present invention is used in a decking application, particularly in a bushfire prone area, one advantage of using continuous length elongate boundary joining elements is that there is no gap between cladding elements to allow hot embers and the like to pass through the deck to any underlying material. Thus elongate boundary joining elements eliminate the gaps traditionally found between decking elements. Removal of these gaps prevents hot embers being able to migrate between decking elements and ignite any flammable materials deliberately or unintentionally present in the ground clearance space beneath the decking.

When the building array of the present invention is used in a cladding application, the building elements and boundary elements are arranged to form a rain screen over the structural substrate. In a further embodiment of the invention there is provided a water impermeable and/or breathable membrane in the form of a building wrap intermediate the building array and the structural substrate to form a water impermeable barrier over the structural substrate.

BRIEF DESCRIPTION OF THE DRAWINGS

The invention will now be described more particularly with reference to the accompanying drawings, which show by way of example only four embodiments of the building array of the invention.

In the drawings.

Figure 1:
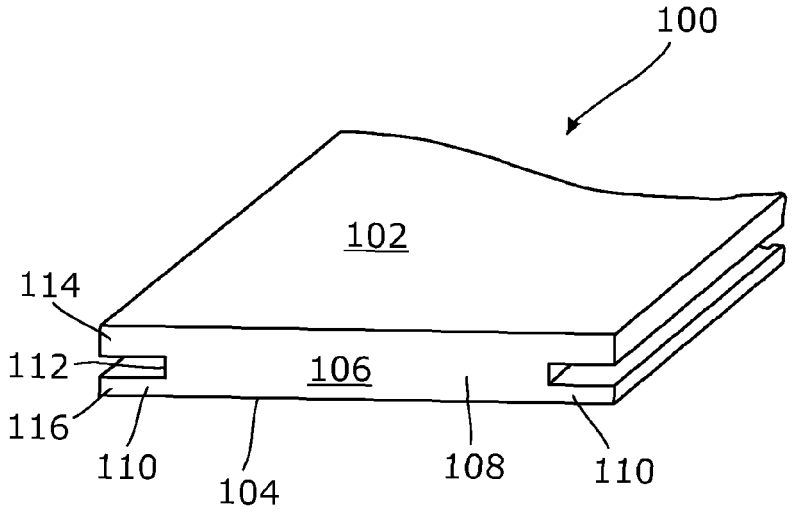
FIG. 1 is a partial perspective view of a building element according to the invention.
Figure 6:
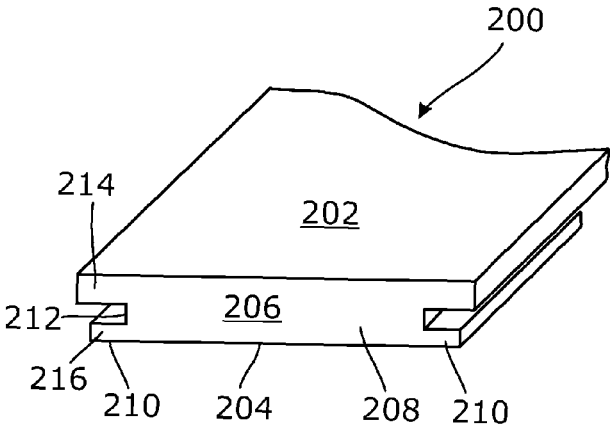
FIG. 6 is a partial perspective view of an alternate configuration of the building element of FIG. 1.

Referring initially to FIGS. 1 and 6, there are shown two embodiments of a building element 100, 200 of the present invention. Building elements 100 and 200 each comprise a first face 102, 202 and a second face 104, 204, the second face being spaced apart from the first face 102, 204 to define an intermediate portion 106, 206 of predetermined thickness. The first face 102, 202 is also defined as the visual surface of building element 100, 200. The thickness of the intermediate portion is variable and is selected by the manufacturer. The thickness of the building elements 100, 200 are tailored to provide consumers with a choice of predetermined thickness options for a given product or product range. In a further embodiment of the building elements of the invention 100, 200 the first face 102, 202 is adapted to receive a range of surface treatments such as a decorative paint finish, tiles, and the like. In another embodiment of the building elements of the invention 100, 200 the second face 104, 204 is also adapted to receive a surface treatment such as a thermal insulation material mechanically or chemically fixed to the face 104, 204 to modify the physical properties of the building array. Optionally, in a further embodiment of the invention both the first 102, 202 and second faces 104, 204 are adapted to receive surface treatments as outlined above.

Building elements 100, 200 of the invention can be formed from any material suitable for use in an exterior or interior building application, as required. Such materials may include timber, engineered cement composites including fibre cement, engineered wood composites, polymers, polymer composites and the like.

The building elements 100, 200 further comprise an integrally formed peripheral edge member 108, 208 extending around the intermediate portion 106, 206. In the embodiments shown, building elements 100, 200 comprise a hexahedron shape whereby four faces of the hexahedron shape are formed by the integrally formed peripheral edge member 108, 208. In the embodiments shown, the integrally formed peripheral edge member 108, 208 comprises two pairs of spaced apart opposing side edges. Each pair of spaced apart opposing side edges are positioned in a contiguous orthogonal arrangement relative to the other pair of spaced apart opposing side edges such that each side edge in a pair is in abutment with both side edges in the other pair, the side edges thereby extending around each side of the substantially rectangular building elements 100, 200 enclosing the intermediate portion 106, 206. Only one pair of spaced apart opposing side edges are shown 110, 210 in FIGS. 1 and 6. In the preferred embodiment of the invention each of the first 102, 202 and second face 104, 204, the intermediate portion 106, 206 and the peripheral edge member 108, 208 are integrally formed together as a single unit.

Each of side edges 110, 210 comprise an edge profile 112, 212. It is to be understood, edge profile 112, 212 can be formed on one or more of the side edges of the building element 100, 200. In the embodiments shown, the edge profile 112, 212 is in the form of a recess or channel or groove. The edge profile 112, 212 is adapted to releasably engage an edge restraining formation 310, 410, 510, 610 as shown in FIGS. 2, 4, 5 and 7. The edge profiles 112, 212 of building elements 100, 200 formed on the elongate side edges 110, 210, divide side edge 110, 210 into a first portion 114, 214 and a second portion 116, 216. In the embodiments shown, edge profile 112, 212 has a predominantly central position on the side edge 110, 210. It is to be understood that the edge profile 112, 212 does not need to be centrally located on the side edge 110, 210 any suitable location known to a person skilled in the art can be used. The relative position of edge profile 112, 212 is selected to provide alternate aesthetic effects within the building array or completed construction. It is preferable when determining the position of the edge profile 112, 212 to leave sufficient material on the visual surface, i.e. the first face 102, 202 to prevent damage during handling and installation.

The difference between the building element 100 of FIG. 1 and building element 200 of FIG. 6 is that the second portion 216 of side edge 210 adjacent edge profile 212 has been shortened relative to first portion 214 of side edge 210.

Figure 2:
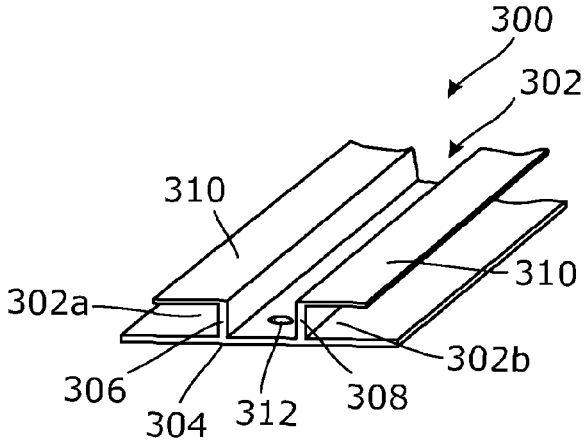
FIG. 2 is a partial perspective view of a boundary joining element according to the invention.
Figure 4:
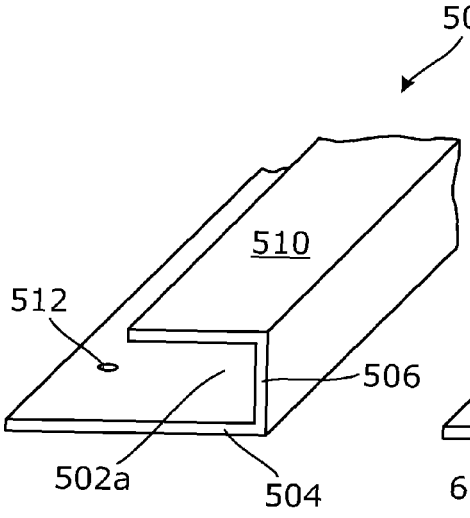
FIG. 4 is a partial perspective view of a boundary edging element according to the invention.
Figure 5:
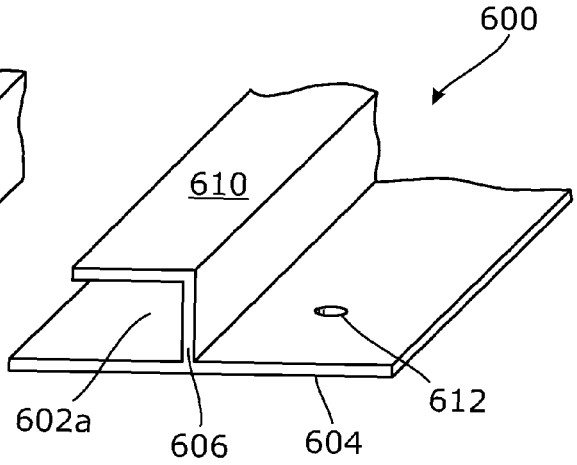
FIG. 5 is a partial perspective view of an alternately configured boundary edging element according to the invention.
Figure 7:
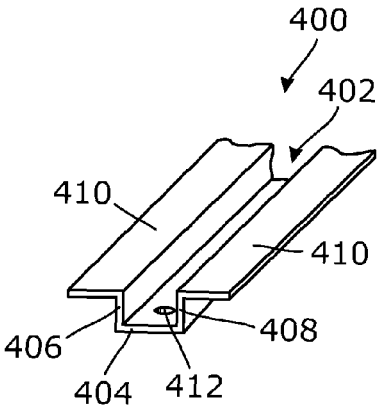
FIG. 7 is a partial perspective view of an alternate configuration of the boundary joining element of FIG. 2.

Referring now to FIGS. 2 4, 5 and 7, there are shown a partial perspective views of four embodiments of a boundary element. The embodiments shown in FIGS. 2 and 7 are boundary joining elements 300, 400, whilst the embodiments shown in FIGS. 4 and 5 are boundary edging elements 500, 600.

Boundary joining elements 300, 400 are configured to form at least one substantially "U" shaped channel 302, 402, having a base member or web 304, 404 from which two spaced apart flanges 306, 308, 406 and 408 extend substantially orthogonally. Each flange 306, 308, 406, 408 terminates in a leg or edge restraining formation 310, 410 extending substantially parallel to base member 304, 404. Boundary joining element 300 differs from boundary joining element 400, in that the base member 304 of boundary joining element 300 extends outwardly in the same plane in opposing directions such that the base member 304 is configured together with flanges 306, 308 and legs 310 to provide three conjoined channels 302, 302*a* and 302*b* Channel 302 is a substantially "U"-shaped channel wherein the base member 304 of the boundary joining element 300 forms the base member and flanges 306, 308 form the side members of channel 302. Channels 302*a* and 302*b* are substantially 'C'-shaped channels facing in opposing directions, flanges 306, 308 form the respective base members of channels 302*a* and 302*b* and base member 304 and edge restraining formation 310 of the boundary joining element 300 form the respective side members of channels 302*a* and 302*b*.

Each of base members 304, 404 are configured to provide fixing indicators 312, 412. As shown in FIGS. 2 and 7, fixing indicators 312, 412 are in the form of at least one aperture. In alternate embodiments of the invention fixing indicators 312, 412 may also be in the form of recesses such as indentations, surface markings as engraved or applied to the surface, and the like. The fixing indicators 312, 412 are provided to show a user the preferred point at which the boundary joining element 300, 400 should be fixed to a structural support member, for example, a timber frame. As detailed below, in use the boundary joining elements 300, 400 are secured to a structural support element, by means of mechanical fixing means such as nails, screws, staples and/or scrails.

Referring now to FIG. 4, there is shown a first boundary edging element 500 for use at an edge of an array of building elements 100, 200. First boundary edging element 500 is suitable for use as the first edge of a building installation. First boundary edging element 500 comprises a first arm or flange 506 extending substantially orthogonally from base member 504. Flange 506 terminates in edge restraining formation or leg 510 extending substantially parallel to base member 504, forming a substantially 'C'-shaped channel 502*a*. Base member 504 includes a number of fixing location indicators 512. In the embodiment shown, fixing indicator 512 is in the form of an aperture. Alternative fixing indicators 512 could be recesses such as indentations or could be surface markings engraved into the surface or applied to the surface. The position of fixing indicators 512 in the embodiment shown requires that first boundary edging element 500 is fixed in position before the first building element 100, 200 is positioned in the building array. Once in place, building elements 100, 200 will obscure the fixing location indicators 512 on first boundary edging element 500.

Referring now to FIG. 5, there is shown an alternate configuration for a boundary edging element 600. Second boundary edging element 600, is also suitable for use at an end of an array of building elements 100, 200. Second boundary edging element 600 has a first flange or arm 606 extending substantially orthogonally from base member 604. Flange 606 supports edge restraining member or leg 610 extending substantially parallel to base member 604 forming a substantially 'C'-shaped channel 602*a*. Fixing indicators 612 in base member 604 provide guidance for users as to preferred or recommended fixing spacings for attaching the boundary edging element 600 to a structural support by means of mechanical fixing. In this example, the location of the fixing indicators 616 is not obscured by positioning of building elements 100, 200. Accordingly second boundary edging element 600 and can be used as either the first installed or the last installed boundary edging element, for providing a restraining edge formation in a building array.

Figure 3:
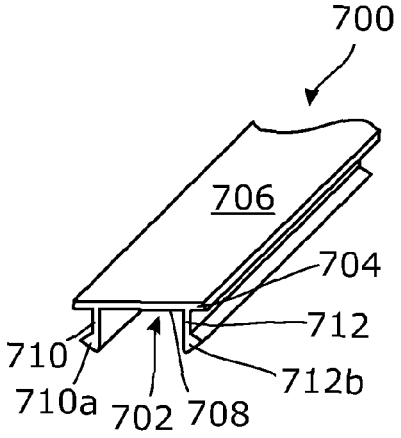
FIG. 3 is a partial perspective view of a cover element according to the invention.

Referring now to FIG. 3, there is shown a cover element 700 of the invention. Cover element 700 is used to conceal at least a portion of boundary joining element 300, 400 of FIGS. 2 and 7. Cover element 700 comprises a substantially 'Omega/Ω'-shaped profile 702 comprising a top or planar member 704 including a first cover element face 706 and a second cover element face 708 and a pair of legs 710, 712, each leg 710, 712 extending substantially orthogonally from the second cover element face 708. Each leg 710 and 712 is provided with a restraining formation 710*a*, 712*b* to form a frictional fit of the cover element 700 into the "U" shaped channel 302, 402 of boundary joining element 300, 400. Although not shown in FIG. 3, the first cover element face 706 has an applied surface treatment (Feature 706*a* of FIG. 10). The surface treatment is selected to suit the material from which cover element 700 is made and is used to provide a low cost aesthetically pleasing finish on the first cover element face 706. For example, when the cover element 700 is a metal cover element, surface treatments include abrading, machining, painting, etching, and/or anodising. Alternatively, in a further embodiment of the invention the surface treatment may consist of applying a polymer trim by chemically fixing the trim to the first cover element face 706. Usually, such a polymer trim would be chemically fixed by gluing.

The boundary elements 300, 400, 500, 600, cover element 700 and channels formed therein are preferably formed by extrusion techniques as known to the person skilled in the art. For, example, where the boundary elements 300, 400, 500, 600 or cover element 700 are formed from a polymer or polymer composite material, the or each element may be formed by any suitable method known in the art, such as extrusion, pultrusion, injection moulding, compression moulding, vacuum forming and line bending. Alternatively, the boundary elements 300, 400, 500, 600 or cover element 700 may be formed from a metal, by commonly known methods such as extrusion. The boundary elements 300, 400, 500, 600 or cover element 700 may also be formed as discrete units or may be formed in predefined lengths, depending on the forming method selected.

Figure 8:
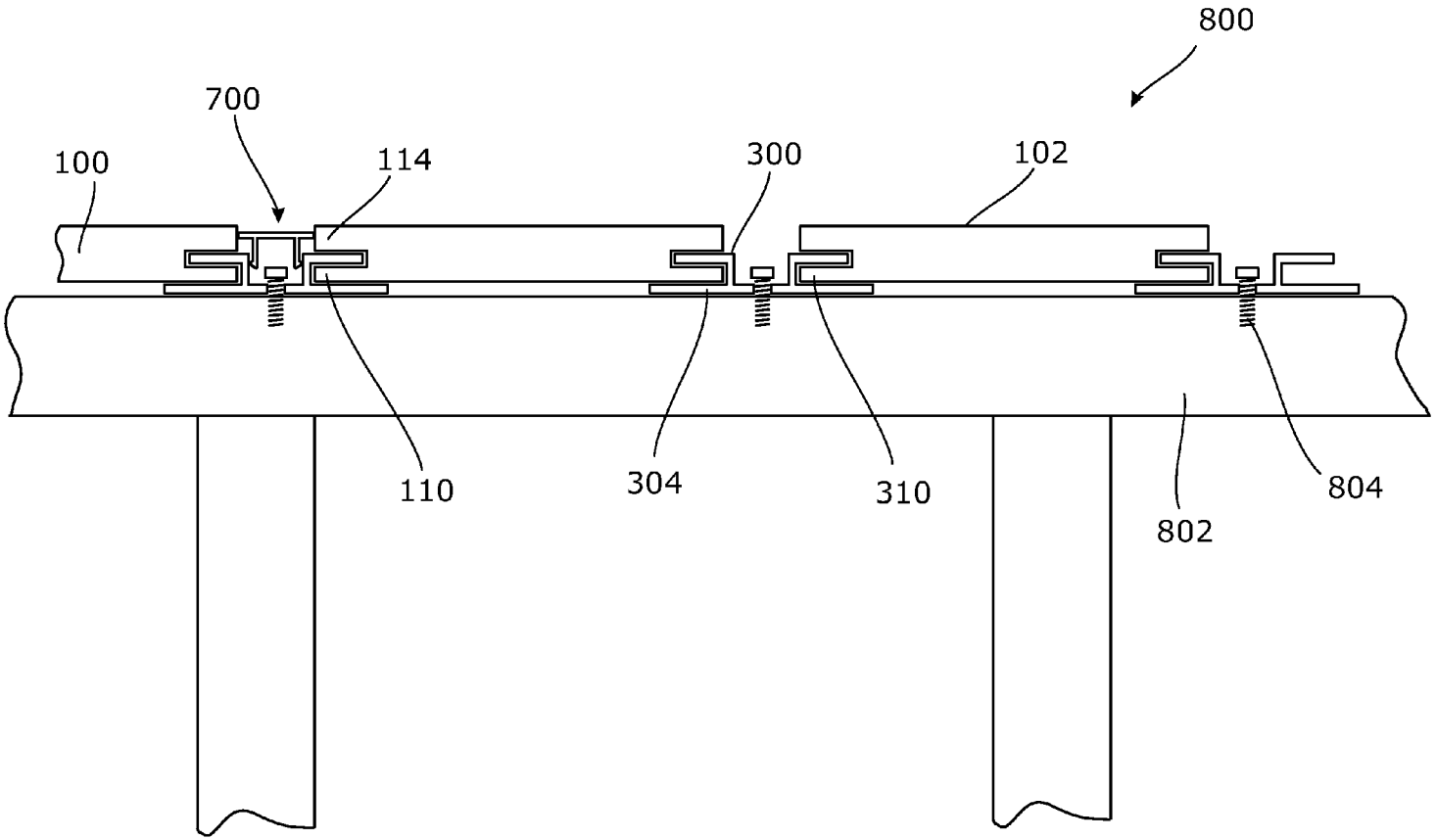
FIG. 8 is a cross-sectional partial side view of a first embodiment of the building array according to the invention
Figure 10:
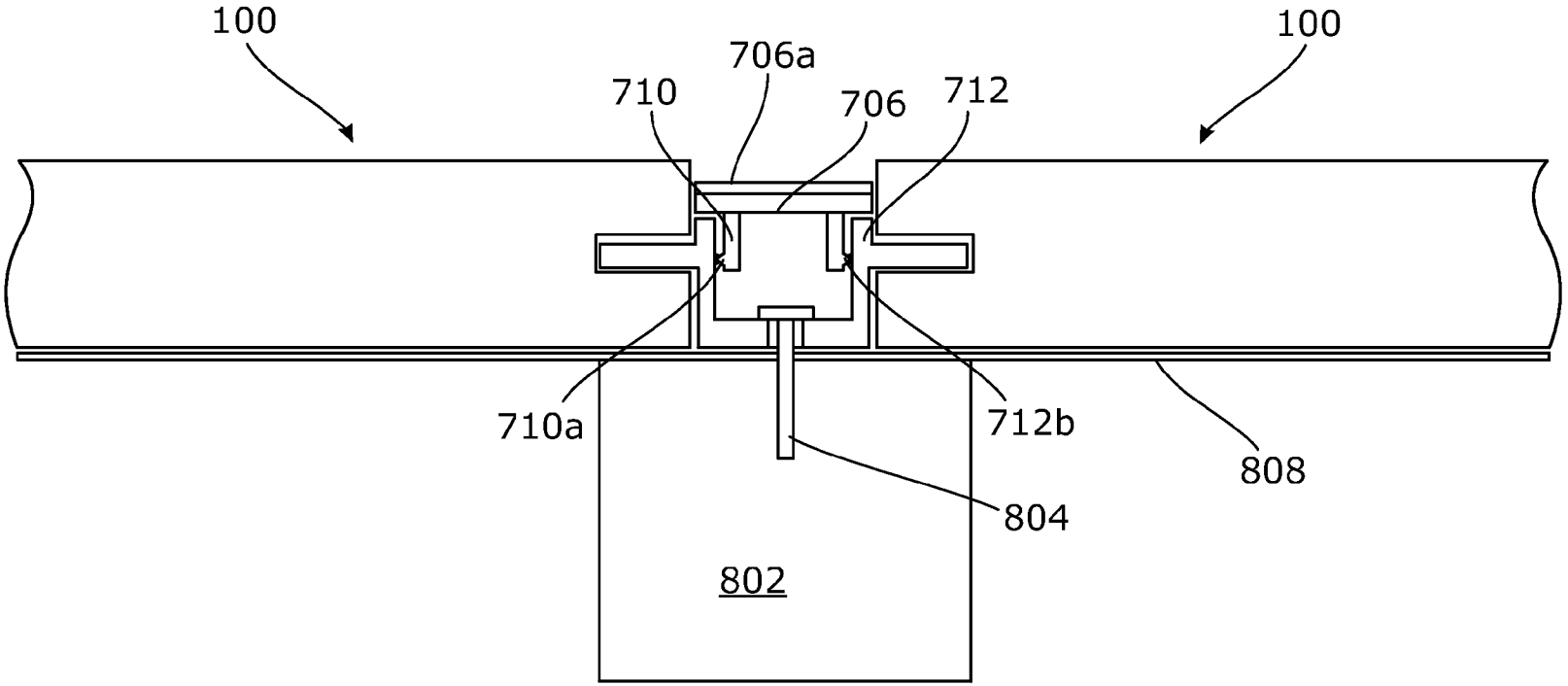
FIG. 10 is a cross-sectional partial side view of a third embodiment of the building array according to the invention.

Referring now to FIGS. 8 and 10, there is shown a cross-sectional partial side view of a first embodiment of an assembled building array in the form of a decking array 800. The portion of decking array 800 shown in FIG. 8 comprises the components of FIGS. 1, 2 and 3 seated together on a structural substrate 802, referred to as a structural decking substrate for the purposes of this embodiment. The portion of decking array shown in FIG. 10 is an enlarged view of a boundary joining element 400 intermediate two adjacent building elements 100. For the sake of clarity, not all of the reference numerals shown in FIGS. 1, 2 and 3 have been replicated on FIGS. 8 and 10. It is to be understood that the reference numerals referred to below in respect of FIGS. 8 and 10 correspond to those elements in common with and as shown in FIGS. 1, 2 and 3.

Although the edge of the area to be covered is not shown, the non-combustible decking array 800 as shown in FIG. 8 is provided by first installing an elongate boundary edging element 500, 600 at one edge of the area to be covered. The elongate boundary edging element 500, 600 is positioned in a user defined location on structural decking substrate 802 and fixed to it in at least one location using at least one conventional fixing means 804 such as nailing, screwing, bolting and the like. A first building element 100 is positioned so that the second portion 116 of side edge 110 is seated within the substantially 'C'-shaped channel 502*a*, 602*a*. In this way, edge member 108 is restrained in position. First portion 114 of side edge profile 110 covers edge restraining formation 510, 610 providing protection for the edge restraining formation 510, 610 and provides an improved aesthetic in the installed array 800.

In the embodiment shown in FIG. 8, a boundary joining element 300 is then positioned such that the second portion 116 of the opposing side edge 110 of the first placed building element 100 is seated within the substantially 'C'-shaped channel 302*a* of boundary joining element 300. The position of this and subsequent boundary joining elements 300 is determined by the size of the building elements 100 being used. Base member 304 of boundary joining element 300 ensures that the second face 104 of building element 100 is slightly raised from structural decking substrate 802 to provide a capillary break. Provision of a capillary break, improves moisture drainage between building elements 100 and structural decking substrate 802 on which building elements 100 are installed.

The procedure of placement of building elements 100, 200 and boundary elements 300, 400, 500, 600 is repeated until the desired area is covered by an array of building elements 100, 200, elongate boundary joining elements 300, 400 and boundary edging elements 500, 600 to form a non-combustible decking array 800. Boundary joining elements 300, 400 and boundary edging elements 500, 600 are placed to prevent movement of the building elements 100, 200 away from the structural decking substrate 802 in lateral and orthogonal directions.

The decking array embodiment shown in FIG. 10 is constructed in a similar way to that of FIG. 8 however the second portion 116 of the opposing side edge 110 of the first building element 100 is seated within the gap formed between the edge restraining formation 410 and the structural decking substrate 802. An optional breathable membrane or building wrap 808 is positioned between the second portion 116 of building element 100 and the structural decking substrate 802. In each case base member 304, 404 is maintained in contact with structural decking substrate 802 and is fixed in place at one or more fixing locations using conventional mechanical fixing means 804.

Cover element 700 is placed in position to cover and conceal the boundary joining element 300, 400 intermediate two adjacent building elements 100. Legs 710 and 712 provide a frictional fit of the cover element 700 into the "U" shaped channel 302, 402 of boundary joining elements 300, 400. Each cover element 700 is positioned by applying pressure to the first cover element face 706 sufficient to overcome the frictional resistance of restraining formations 710*a*, 712*b* and to urge legs 710 and 712 into the recess of the substantially 'U'-shaped channel 302, 402 of boundary joining elements 300, 400. The travel distance of the cover element 700 is limited by the second cover element face 708 contacting the ends of flanges 306, 308, 406, 408 of boundary joining elements 300, 400 remote from the base element 304, 404. Cover element 700 is maintained in position by tension forces between restraining formation 710*a* and 712*b* and flanges 306, 308, 406, 408 of joining elements 300, 400.

Figure 9:
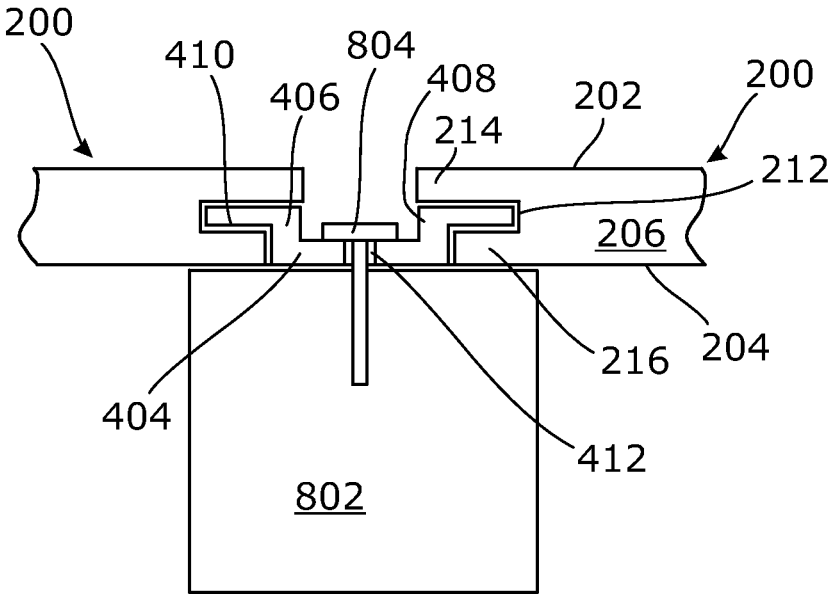
FIG. 9 is a cross-sectional partial side view of a second embodiment of the building array according to the invention.

Referring now to FIG. 9, there is shown a similar building array to that shown in FIG. 8, wherein the building elements 200 (FIG. 6) are joined using the boundary joining element 400 (FIG. 7) to form the non-combustible decking array. In this embodiment of the invention the building element 200 as shown in FIG. 6 and boundary joining element 400 as shown in FIG. 7 are configured so that building element 200 has second portion 216 of side edge 210 recessed compared to first portion 214 of side edge 210. In this way, when edge profile 210 is releasably engaged with edge restraining formation 410 of boundary joining element 400, each edge restraining formation 410 are concealed from direct view by first portion 214 of side edge 210 of building element 200. Mechanical fixings 804 and/or fixing indicators (not shown) are visible in this configuration. The decking array of FIG. 9 is constructed in the same manner as described for FIGS. 8 and 10.

In a decking application, particularly for a bushfire prone area, one advantage of using continuous length elongate boundary joining elements is that there is no gap between cladding elements to allow hot embers and the like to pass through the deck to any underlying material. Thus elongate boundary joining elements eliminate the gaps traditionally found between decking elements. Removal of these gaps prevents hot embers being able to migrate between decking elements and ignite any flammable materials deliberately or unintentionally present in the ground clearance space beneath the decking. Building elements 100, 200, boundary joining elements 300, 400, 500 and 600 and cover element 700 are each formed from non-combustible materials and so will also prevent combustion of the decking structure caused by contact with hot embers.

Figure 11:
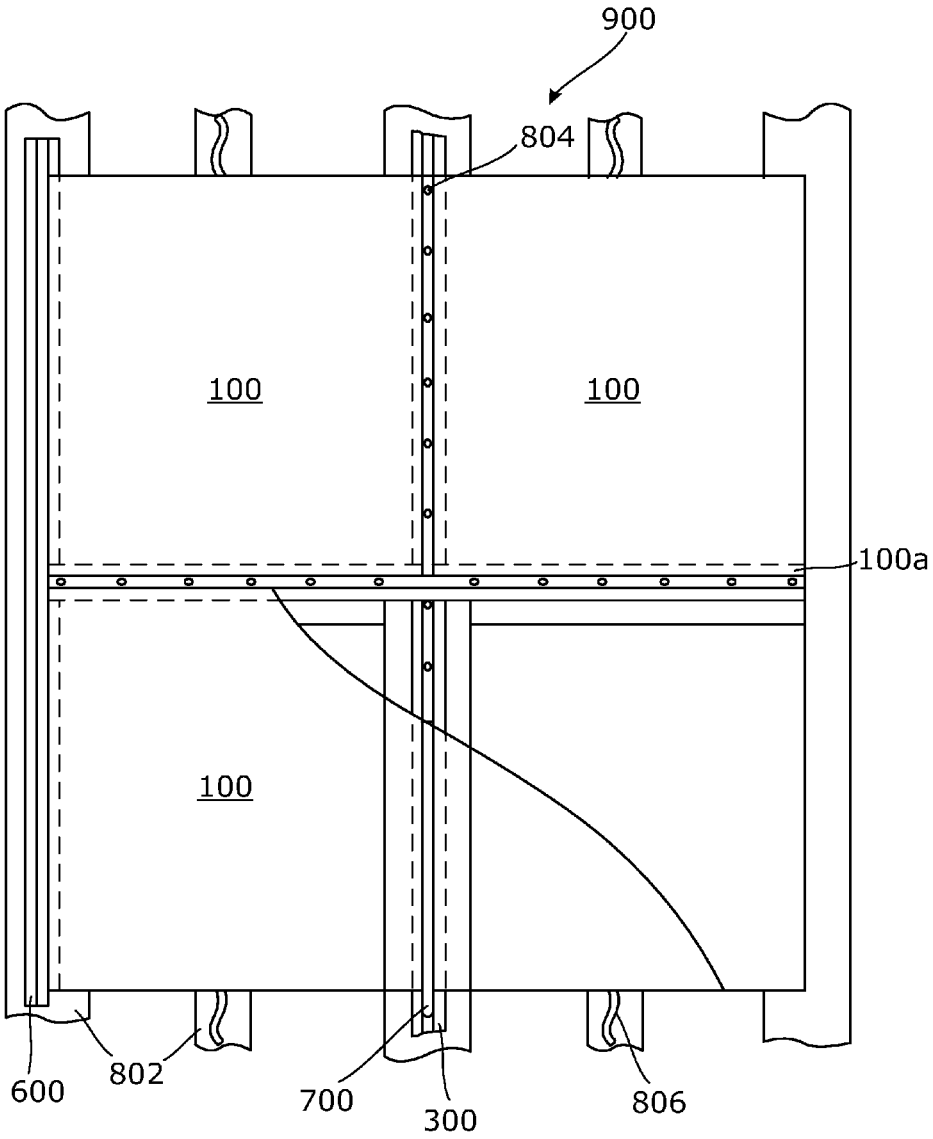
FIG. 11 is a front partial-sectional view of a fourth embodiment of the building array according to the invention.
Figure 12:
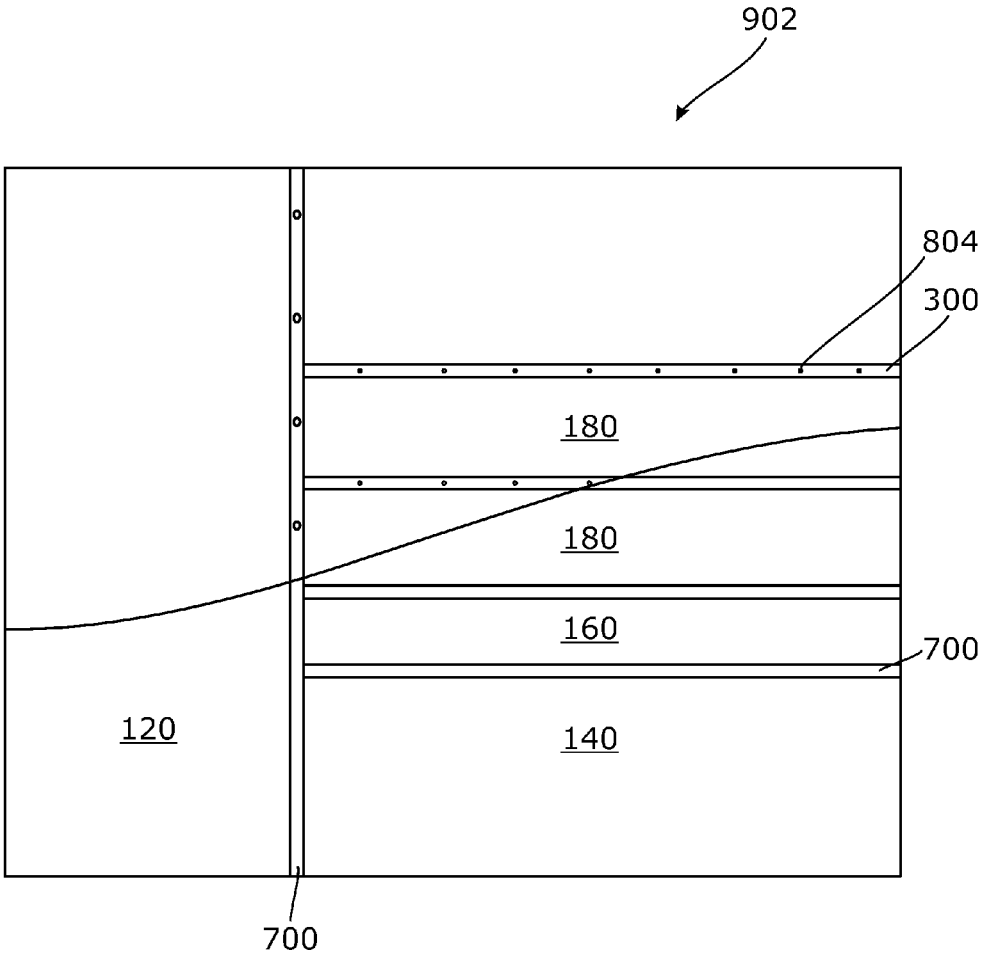
FIG. 12 is a front partial-sectional view of a fifth embodiment of the building array according to the invention.

Referring now to FIGS. 11 and 12, there is shown a front partial-sectional view of a façade cladding system 900, 902. The façade cladding system 900 comprises a boundary edging element 600 and a boundary joining element 300 which is fixed to structural substrate element 802 in a predetermined position using mechanical fixings 804 such as nails, screws, scrails, staples and the like, and a plurality of building elements or façade panels 100.

Façade panels 100 are positioned so that an edge profile 112 releasably engages an edge restraining formation 610, 310 of boundary edging element 600 and boundary joining element 300 respectively. Optionally, adhesive 806 may be used on some structural support elements 802 to provide either a temporary or a permanent benefit in the façade construction, either acting simply as an aid to installation or to provide additional mechanical strength to the constructed façade. Where this option is used, adhesive 806 makes contact with second face 104 of building elements or façade panels 100 when in position. It is to be understood that in the example shown building elements 100 are used, any other suitable type of building element, for example, building element 200 could also be used in the façade cladding system of the invention.

Once a building element or façade panel 100 is fixed in a desired position, additional boundary joining elements 300 are positioned such that one of a pair of edge restraining formations 310 releasably engages an edge profile 112 on building element 100. Boundary joining elements 300 may be discrete elements or may be lengths sufficient to restrain a side edge of one cladding element or sufficient to restrain several cladding elements. The base member 304 of each boundary joining element 300 is fixed to structural support element 802 in user selectable positions. Fixing indicator positions 312 may be indicated by markings or recesses in, or apertures through, base member 304. Fixing indicator positions 312 enable consistent and reproducible fixing spacing guides for installers. In practice, a first building element 100 is positioned, and two adjacent edges are restrained by installing at least one boundary joining element 300. In FIG. 11, the lower two building elements or façade panels 100 are shown in cutaway view to more clearly show the arrangement of underlying structural support element 802 and boundary joining elements 300. The dotted line 100*a* outlines show the depth of the side edge profiles 112 and the edge restraining formations 310 provided by each boundary joining element 300.

In this example building element 100, is a façade panel with a factory applied coating. In alternate embodiments, the coating may be applied onsite during installation. Factory applied coatings may include several layers, but has at least one layer performing as a top coat which may perform a decorative and/or protective function. The façade panel may be coated on some or all sides, however at least the building element first face or visual surface 102 is intended to have an applied top coat.

It is understood that façade cladding systems do not need to use building elements or façade panels all of the same dimensions. Interesting and aesthetically pleasing façades can be constructed by combining cladding elements of various sizes. Referring now to FIG. 12, there is shown a façade cladding system 902, comprising building elements 120, 140, 160 and 180 of varied sizes restrained in position by boundary joining elements 300 fixed to a structural support element, such as a timber frame (not shown). Fixing elements 804 are visible in the façade system unless cover elements 700 are used to conceal them. In FIG. 12, a partial cutaway view of a constructed façade system shows cover elements 700 installed to provide an aesthetic highlight. First face 122, 142, 162 and 182 of building elements 120, 140, 160 and 180 in this example has a factory applied paint finish, including a top coat.

It will be appreciated that the cladding system as illustrated in FIGS. 11 and 12 provides a cladding system that is quick and simple to install and that enables an aesthetically acceptable level of surface finish to be achieved in a completed construction without the need for face fixing of the building elements of the building array to a structural substrate.

It will of course be understood that the invention is not limited to the specific details described herein, which are given by way of example only, and that various modifications and alterations are possible within the scope of the invention as defined in the appended claims.

The invention claimed is:

1. A building array comprising at least one building element comprising a first face, a second face and a peripheral edge member, the first face and second face being spaced apart to define an intermediate portion, the peripheral edge member extending around the intermediate portion whereby at least a portion of the peripheral edge member comprises an edge profile;

at least one boundary element comprising a planar base member removably attachable to a structural support element, at least one flange extending substantially orthogonally from the planar base member and an edge restraining formation extending laterally from the flange remote from the planar base member, wherein the edge restraining formation is configured for releasably engaging with the edge profile of the building element, whereby the at least one building element and the at least one boundary element are arrangeable together in series on a structural support element to form the building array; and at least one cover element for concealing at least a portion of a boundary element, wherein the cover element includes a protrusion extending from at least a portion of the first cover element face.

2. A building array as claimed in claim 1, wherein each of the first and second face, the intermediate portion and the peripheral edge member are integrally formed together as a single unit.

3. A building array as claimed in claim 1, wherein the thickness of the intermediate portion is variable.

4. A building array as claimed in claim 1, wherein the peripheral edge member comprises two pairs of spaced apart opposing side edges positioned in a contiguous orthogonal arrangement relative to each other such that each side edge in a pair is in abutment with both side edges in the other pair thereby extending around each side of a substantially rectangular building element enclosing the intermediate portion.

5. A building array as claimed in claim 1, wherein the edge profile can be formed on one or more of the side edges of the building element.

6. A building array as claimed in claim 1, wherein the edge profile divides the peripheral edge member of the building element into a first portion and a second portion, the first portion corresponding to the section of the building element including and adjacent to the first face and the second portion of the building element including and adjacent to the second face.

7. A building array as claimed in claim 1, wherein the second portion of the building element is smaller relative to the first portion.

8. A building array as claimed in claim 1, wherein the edge profile is in the form of a recess, channel or groove.

9. A building array as claimed in claim 1, wherein the first face is adapted to receive a range of surface treatments.

10. A building array as claimed in claim 1, wherein the second face is adapted to receive a range of surface treatments.

11. A building array as claimed in claim 1, wherein the surface treatments are mechanically or chemically fixed to the first and/or second face to modify the aesthetic or physical properties of the building array.

12. A building array as claimed in claim 1, wherein the boundary element comprises a boundary joining element, comprising at least two spaced apart flanges extending substantially orthogonally from the planar base member, whereby the two spaced apart flanges and base member are configured to form at least one substantially "U" shaped channel each flange terminating in a edge restraining formation extending substantially parallel to the planar base member.

13. A building array as claimed in claim 1, wherein the boundary joining element comprises a planar base member which is configured together with flanges to provide three conjoined channels wherein the central channel is a substantially "U"-shaped channel, the base member and flanges of the boundary joining element forming the base member and side members of the central channel and the channels on either side of the central channel are substantially 'C'-shaped channels facing in opposing directions, the flanges, base member and edge restraining formation forming the base members and respective side members of each channel.

14. A building array as claimed in claim 1, wherein the base member of the boundary element further comprises at least one fixing indicator selected from the group comprising apertures, recesses, and surface markings.

15. A building array as claimed in claim 1, wherein the cover element comprises a top member including a first cover element face and a second cover element face and a pair of legs, each leg extending substantially orthogonally from the second cover element face.

16. A building array as claimed in claim 15, wherein the each leg of the cover element further comprises a restraining formation shaped to form a frictional fit of the cover element into the "U" shaped channel of the boundary joining element.

17. A building array as claimed in claim 16, wherein the flanges of the boundary joining element are provided with a detent to seat and hold the restraining formation of the cover element.

18. A building array as claimed in claim 1, wherein the cover element further comprises a surface treatment applied to the first cover element face.

19. A building array as claimed in claim 18, wherein the surface treatment is selected from the group comprising abrading, machining, painting, etching, and anodising.

20. A building array as claimed in claim 18, wherein least the surface treatment comprises applying a polymer trim.

21. A building array as claimed as claimed in claim 20, wherein the polymer trim is chemically fixed to the first cover element face.

22. A building array as claimed in claim 1, wherein at least one of the boundary elements are removably attachable to the structural support by mechanical fixing.

23. A building array as claimed in claim 22, wherein the mechanical fixings are selected from at least one of the group comprising nails, screws, staples, and scrails.

24. A building array as claimed in claim 1, wherein at least the first face of each building element is prefinished.

25. A building array as claimed in claim 24, wherein the prefinish is a top coat.

26. A building array as claimed in claim 25, wherein the top coat is applied during manufacture.

27. A building array as claimed in claim 1, wherein the non-combustible building elements are formed from fibre cement.

28. A building array as claimed in claim 1, wherein the non-combustible boundary elements are formed from a material selected from the group comprising metals, ceramics, fire-retardant polymers and composites.

29. A building array as claimed in claim 1, wherein the boundary element is formed by a method selected from the group comprising extrusion, pultrusion, injection moulding, compression moulding, vacuum forming and line bending.

30. A building array as claimed in claim 1, wherein the boundary element is formed from a metal, polymer or polymer composite material.

* * * * *